US005938199A

United States Patent [19]

Doederlein et al.

[11] Patent Number: 5,938,199

[45] **Date of Patent: *Aug. 17, 1999**

[54] SQUEEZABLE TALKING TRADING CARDS

[75] Inventors: Dieter D. Doederlein, Mississauga; G. Dale Newman, Unionville; Brian J. Burgess, Newmarket; Anthony C. Sharp, Agincourt, all of Canada

[73] Assignee: The M2000 Group Inc., Richmond Hill, Canada

[ * ] Notice: This patent is subject to a terminal disclaimer.

[21] Appl. No.: 08/577,315

[22] Filed: Dec. 22, 1995

Related U.S. Application Data

[63] Continuation of application No. 08/322,135, Oct. 13, 1994, Pat. No. 5,480,156.

[51] Int. Cl.[6] ..... G09F 1/00

[52] U.S. Cl. ..... 273/237; 40/457

[58] Field of Search ..... 273/237; 40/457

[56] References Cited

U.S. PATENT DOCUMENTS

| | | | |
|---|---|---|---|
| 3,691,312 | 9/1972 | Peterson | 273/237 |
| 3,798,806 | 3/1974 | Sanford | 273/237 |
| 3,857,191 | 12/1974 | Sadorus | 273/237 |
| 4,531,310 | 7/1985 | Acson et al. | 273/237 |
| 4,607,747 | 8/1986 | Steiner | 273/237 |
| 4,703,573 | 11/1987 | Montgomery et al. | 273/237 |
| 4,791,741 | 12/1988 | Kondo | 273/237 |
| 4,866,865 | 9/1989 | Yang | 273/237 |
| 4,934,079 | 6/1990 | Hoshi | 273/237 |
| 5,010,665 | 4/1991 | Clinkscales | 273/237 |
| 5,030,485 | 7/1991 | Meeks et al. | 273/237 |
| 5,063,698 | 11/1991 | Johnson et al. | 273/237 |
| 5,182,872 | 2/1993 | Lee et al. | 273/237 |
| 5,215,792 | 6/1993 | Miller | 273/237 |
| 5,275,285 | 1/1994 | Clegg | 273/237 |
| 5,433,035 | 7/1995 | Bauer | 273/237 |
| 5,480,156 | 1/1996 | Doederlein et al. | 273/237 |

*Primary Examiner*—Vincent Millin
*Assistant Examiner*—Charles W. Anderson
*Attorney, Agent, or Firm*—Bereskin & Parr

[57] ABSTRACT

A trading card capable of generating sounds comprises a thin housing having front and back surfaces, flexible sheets affixed to the front surface and to the back surface of the housing, a voice chip located in the housing for generating patterns of sounds, a battery located in the housing for supplying electrical power to the voice chip, and a switch located in the housing for activating the voice chip. The subject trading card may be activated by squeezing the flexible sheets between the thumb and forefinger at a selected switch location.

8 Claims, 2 Drawing Sheets

SQUEEZABLE TALKING TRADING CARDS

This is a continuation, of application Ser. No. 08/322.135 filed Oct. 13, 1994. Now U.S. Pat. No. 5,480,156.

BACKGROUND OF THE INVENTION

This invention relates to collectable cards, and in particular, sports trading cards such as baseball cards, hockey cards and the like.

Baseball cards and other sports trading cards have been available since the turn of the century. These cards typically display an action photograph or other image of a baseball player or other athlete on the front face, and statistics and other personal information about the player on the back face. Collecting and trading baseball cards and other sports cards is a popular hobby engaged in by both children and adults. Sports cards tend to appreciate in value over the years, with rare cards such as the 1909 Honus Wagner baseball card being valued at several hundred thousand dollars.

In recent years, collecting sports cards has increased in popularity, particularly among younger collectors. Card manufacturers have responded to this increase in popularity by introducing innovations such as holographic logos and gold-plated collector sets. However, conventional sports trading cards are passive, and the information provided thereon has remained relatively constant over the years. The present inventors have recognized a need and demand for sports cards which provide more information and value than that available on conventional passive sports cards.

SUMMARY OF THE INVENTION

The present invention is accordingly directed to an active trading card which provides not only graphics and text, but also sounds, such as a player's voice. The subject invention not only increases the information provided by sports cards, but also increases their appeal to collectors, particularly adults.

The subject trading card comprises a thin housing having front and back surfaces, flexible sheets affixed to the front and back surfaces, sound generating means located in the housing for generating preselected patterns of sounds, power means located in the housing for supplying electrical power to the sound generating means, and activation means located in the housing for activating the sound generating means.

In a preferred embodiment, the subject invention includes activation means in the form of a snap switch sandwiched between the front and back flexible sheets which can be activated merely by squeezing the sheets between the thumb and index fingers. This construction eliminates the need for an unsightly switch button which protrudes beyond the flat front face of the card. The subject switch also allows the entire front and back faces of the card to be filled with graphics or text.

The subject trading card also preferably utilizes a long-life replaceable battery mounted in a battery cavity covered by a battery cap which fits along one edge of the card. This battery cavity construction eliminates the need for cutouts, flaps or other battery door on the face of the card, thereby enabling the entire front and back faces of the card to be used for decoration.

The subject squeezable talking trading card has an unusually thin profile, in the range of 2 to 3 mm. The card employs a voice chip which reproduces sound of unusually good quality, considering the small dimensions of the card. The trading card of the subject invention is also relatively simple and inexpensive.

DETAILED DESCRIPTION OF THE PREFERRED EMBODIMENT

Figure 1:
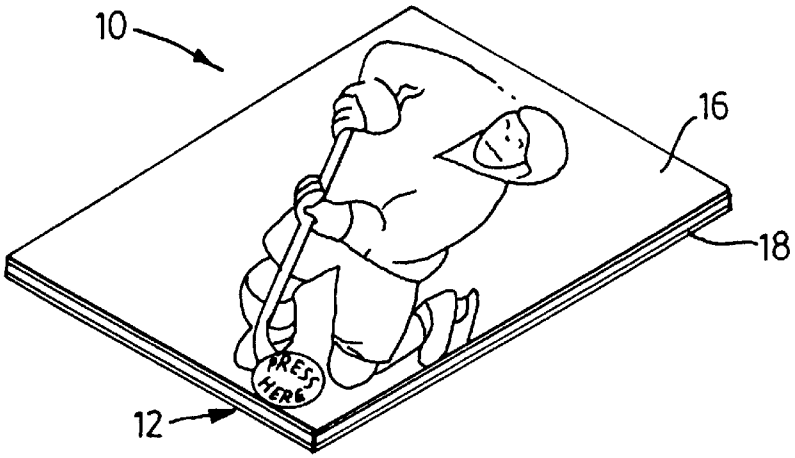
FIG. 1 is a perspective view of a preferred embodiment of a trading card made in accordance with the subject invention.

As shown in FIG. 1, in a preferred embodiment, the subject talking trading card 10 comprises a thin rectangular housing shown generally as 12 having thin flexible sheets 16, 18, adhesively affixed to the front and back surfaces of housing 12. Sheets 16, 18 are preferably card stock or other flexible substrates suitable for printing. Typically, front sheet 16 is printed with a reproduction of a color photograph or other image of the sports player featured on the card, and back sheet 18 is printed with statistics and other personal information about the player.

Referring now to FIGS. 2–5, the front surface of housing 12 comprises a flat front panel 20, and the back surface of housing 12 comprises a thin narrow frame 22 extending outwardly from the back of front panel 20 around the periphery thereof.

The dimensions of front panel 20 are preferably equal to the dimensions of conventional sports trading cards, i.e. 2.5 by 3.5 inches. The thickness of housing 12 is preferably in the range of 2 to 3 mm.

Figure 5:
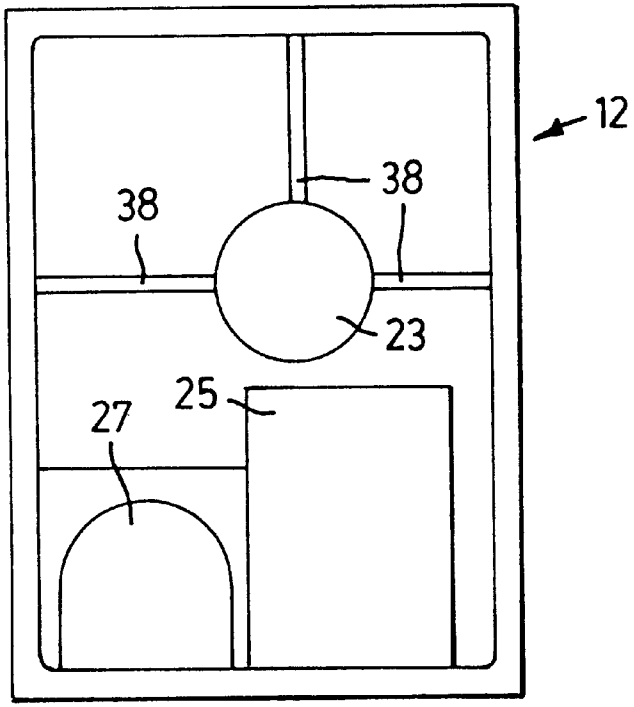
FIG. 5 is a bottom plan view of the housing of the preferred embodiment.

As shown in FIG. 5, front panel 20 of housing 12 is provided with circular aperture 23 approximately in the middle thereof for receiving speaker 24, a rectangular aperture 25 for receiving printed circuit board 26 and a generally rectangular battery aperture 27 having a rounded inside edge for receiving battery 28. Housing 12 preferably includes reinforcing ribs 38 which extend outwardly from the back of front panel 20, to provide some rigidity to housing 12.

Figure 2:
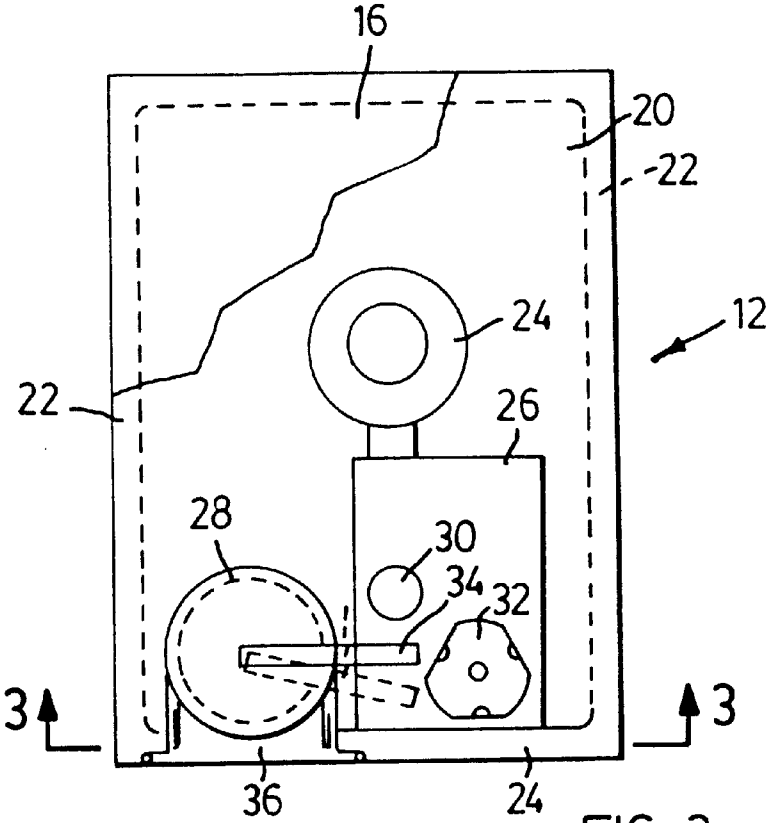
FIG. 2 is a partially cut-away top plan view of the preferred embodiment.
Figure 3:
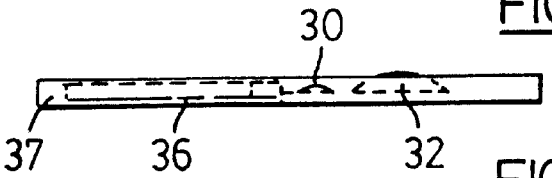
FIG. 3 is a sectional view taken along lines 3—3 in FIG. 2.
Figure 4:
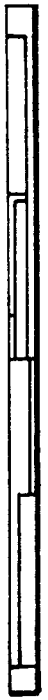
FIG. 4 is a sectional view taken along lines 4—4 in FIG. 2.

As best shown in FIG. 2, the sound generating means of the subject invention comprises speaker 24 and voice chip 30 mounted on a flexible printed circuit board 26. Snap switch 32 mounted on printed circuit board 26 activates voice chip 30. Battery 28 provides electrical power to printed circuit board 26 by means of spring loaded battery contacts 34. Battery cap 36 is a plastic plug which is shaped to fit in the mouth of battery aperture 27 along the bottom side edge 37 of housing 12.

Voice chip 26 may be a single chip integrated circuit utilizing VLSI technology, comprising a 360K ROM for voice data storage, adapted to be powered by a power supply in the range of 2.4 volts to 5.0 volts. Voice chip 26 is preferably capable of providing voice or other sound output of approximately 10–90 seconds long at 5K sampling rate. Battery 28 is preferably a thin circular 3 volt manganese oxide/lithium battery, which has a multi-year lifetime in this application under normal usage. Snap switch 32 preferably comprises a resilient dome-switch contact plate which comes into contact with a second plate when finger pressure is applied thereto.

Voice chip 26 generates a preselected output signal which recreates the sports player's voice or other recognizable voice or sound recording related to the person being featured on the card. Voice chip 26 is programmed by the voice chip manufacturer, using a sound recording stored on an audio tape or the like. This sound recording is digitized by the manufacturer, using a sampling rate of 5K or the like, and stored in the voice chip's ROM storage.

Figure 6:
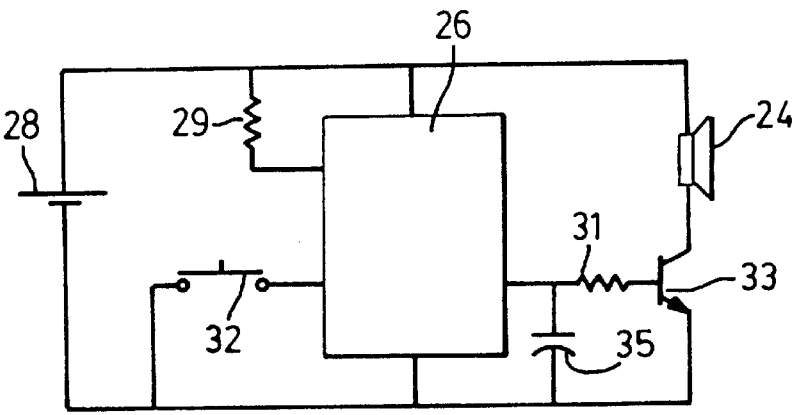
FIG. 6 is a simplified circuit diagram of the electrical components of the preferred embodiment of the subject invention.

Referring now to FIG. 6, battery 28 and resistor 29 maintain voice chip 26 at a 3V input voltage. Resistor 31, transistor 33 and capacitor 35 drive speaker 24 with an output signal from voice chip 26.

In operation, the voice chip 26 is activated by squeezing flexible sheets 16, 18 at the switch location, designated by a suitable message on front sheet 16, such as "Press Here". Switch 32 closes the circuit shown in FIG. 6, thereby drawing current from battery 28 to voice chip 26. The output of voice chip 26 is converted into an analogue signal and amplified by electrical components 31, 33 and 35 to drive speaker 24, and thereby generate sounds. When the output voice signal is completed, voice chip 26 automatically shuts off. The current drawn by voice chip 26 during its quiescent state is low enough that battery 28 should last for many years. Further, the battery replacement feature makes the subject trading card capable of generating sounds for an indefinite period of time.

While the subject invention has been illustrated and described with respect to sports trading cards, it is, equally applicable to other types of collectible cards, such as cards pertaining to entertainment, politics, history, religion, nature and other applications.

Thus, while what is shown and described herein constitutes a preferred embodiment of the subject invention, it should be understood that various changes can be made without departing from the subject invention, the scope of which is defined in the appended claims.

We claim:

1. A trading card capable of generating sounds, comprising:

(a) a thin housing having front and back surfaces;

(b) flexible sheets affixed to the front surface and to the back surface of the housing, the sheets displaying images and information of value to card traders;

(c) sound generating means located in the housing for generating preselected patterns of sounds;

(d) power means located in the housing for supplying electrical power to the sound generating means; and (e) activation means located in the housing for activating the sound generating means.

2. The trading card defined in claim 1, wherein the front surface of the housing comprises a flat planar front panel and the back surface comprises a thin narrow planar frame extending around the back of the periphery of the front panel, and wherein the activation means comprises a snap switch located in an aperture in the housing at a preselected switch location, the snap switch being sandwiched between the flexible sheets and activated when the flexible sheets are squeezed together at the preselected switch location.

3. The trading card defined in claim 2, wherein the snap switch comprises a resilient dome-shaped metal contact plate spaced from a flat metal contact plate, the dome-shaped contact plate being adapted to move towards and contact the flat contact plate when finger pressure is applied thereto.

4. The trading card defined in claim 2, wherein the sound generating means comprises:

(a) storage means for storing digital signals representative of preselected patterns of sound;

(b) processing means for converting the stored digital signals into analogue electrical signals; and (c) speaker means for receiving the analogue signals and creating sounds correlatable therewith.

5. The trading card defined in claim 2, wherein the front panel of the housing has apertures therein for receiving components of the sound generating means, the power means and the activation means.

6. The trading card defined in claim 5, wherein the panel apertures include a battery aperture which extends to an edge of the front panel.

7. The trading card defined in claim 6, wherein the power means comprises a thin replaceable battery dimensioned to fit into the battery aperture, and a battery cap dimensioned to cover the edge portion of the battery aperture.

8. The trading card defined in claim 6, wherein the back surface of the housing also comprises a plurality of reinforcing ribs.

* * * * *

UNITED STATES PATENT AND TRADEMARK OFFICE

CERTIFICATE OF CORRECTION

PATENT NO. : 5,938,199

DATED : August 17, 1999

INVENTOR(S) : Dieter D. Doederlein et al.

It is certified that error appears in the above-identified patent and that said Letters Patent is hereby corrected as shown below:

Item [73] should read:

Assignee: Micra SoundCards Inc., Richmond Hill, Ontario

Signed and Sealed this

Tenth Day of April, 2001

*Attest:*

Nicholas P. Godici

NICHOLAS P. GODICI

*Attesting Officer*

*Acting Director of the United States Patent and Trademark Office*